US005169225A

United States Patent [19]

Palm

[11] Patent Number: 5,169,225

[45] Date of Patent: Dec. 8, 1992

[54] POWER TOOL WITH LIGHT

[75] Inventor: Bernhard Palm, Brookfield, Wis.

[73] Assignee: Milwaukee Electric Tool Corporation, Brookfield, Wis.

[21] Appl. No.: 796,820

[22] Filed: Nov. 25, 1991

[51] Int. Cl.[5] ..... B25K 23/18

[52] U.S. Cl. ..... 362/118; 362/157

[58] Field of Search ..... 362/109, 119, 157, 208, 362/190, 191, 253

[56] References Cited

U.S. PATENT DOCUMENTS

| | | | |
|---|---|---|---|
| 2,517,882 | 8/1950 | Johnson | 362/119 |
| 2,525,588 | 10/1950 | Cameron et al. | 362/119 |
| 2,822.615 | 2/1958 | Dorst et al. | 362/119 |
| 4,160,857 | 7/1979 | Nardella et al. | 429/97 |
| 4,833,782 | 5/1989 | Smith | 362/119 |

*Primary Examiner*—Richard R. Cole
*Attorney, Agent, or Firm*—Bayard H. Michael

[57] ABSTRACT

The power pack (battery pack) which is removably mounted on the lower end of the pistol grip portion of the hand power tool is provided with a light mounted in a slider mounted in the power pack for movement between a retracted position in which in conforms to the contour of the power pack and a projecting position in which the light is connected across the battery supply and projects the light beam upwardly and forwardly of the tool to illuminate the work area.

6 Claims, 2 Drawing Sheets

POWER TOOL WITH LIGHT

BACKGROUND OF THE INVENTION

This invention relates to hand power tools and particularly to a power tool powered by a power (battery) pack which contains a light source which is used to illuminate the work area and is removable from the tool with the power pack at which time the power pack and light can be used as a flashlight.

SUMMARY OF THE INVENTION

A feature of this invention is the provision of a hand power tool with a light which can be turned on to illuminate the work area.

More particularly, this invention provides such a light source for a battery operated hand power tool.

A further feature is to incorporate the light source into the removable power (battery) pack of a battery operated hand power tool, thus enabling the power pack and light to be used as a flashlight separate from the power tool.

Still another feature is the provision of a light in the power pack of a battery operated hand-held power tool of the type having pistol grip type housing with the power pack a removably connected to the bottom of the pistol grip. This positions the light far enough from the axis of the motor and tool to avoid casting a shadow on the work area.

Another feature is that the light is mounted in the power pack for movement between a projecting position, in which it projects from the power pack and illuminates the work area, and a retracted position in which it conforms to the shape of the power pack and is protected thereby. Movement of the light between the positions operates the switch.

DETAILED DESCRIPTION OF THE DRAWINGS

Figure 1:
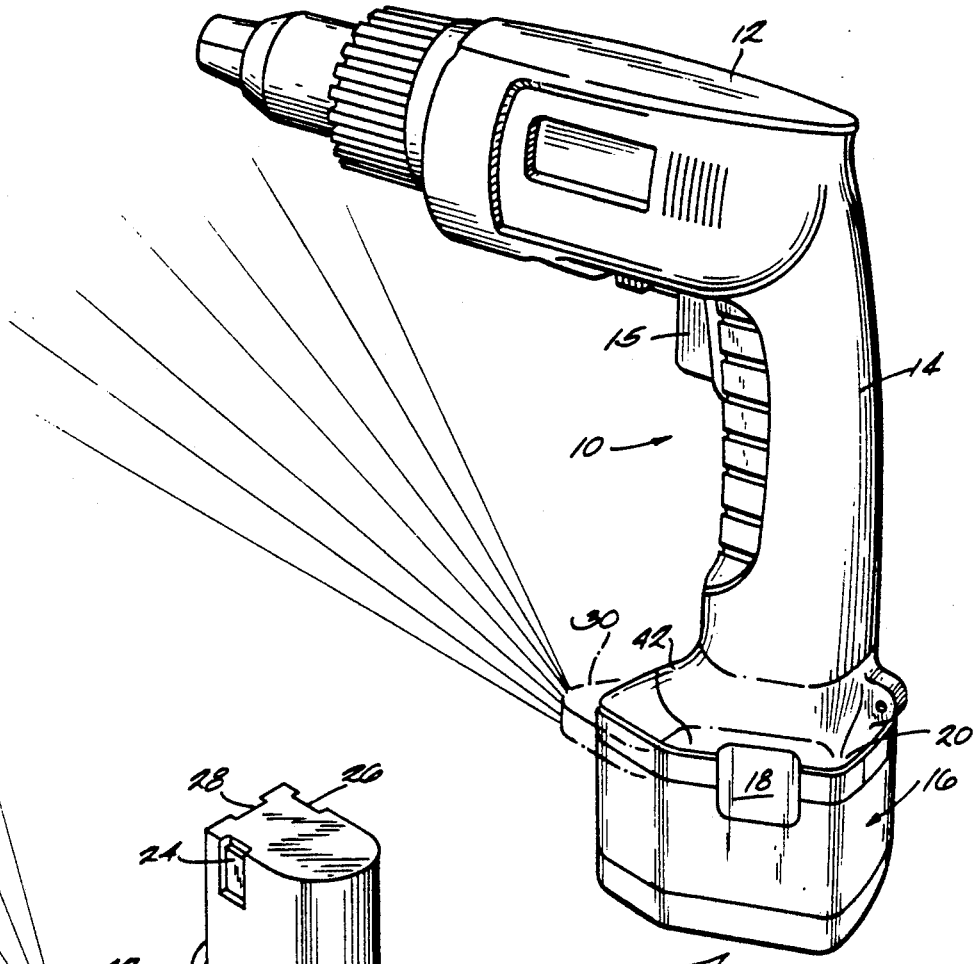
FIG. 1 is a perspective view of a battery powered power tool having the light incorporated in the power pack with is connected to the bottom of the grip.
Figure 2:
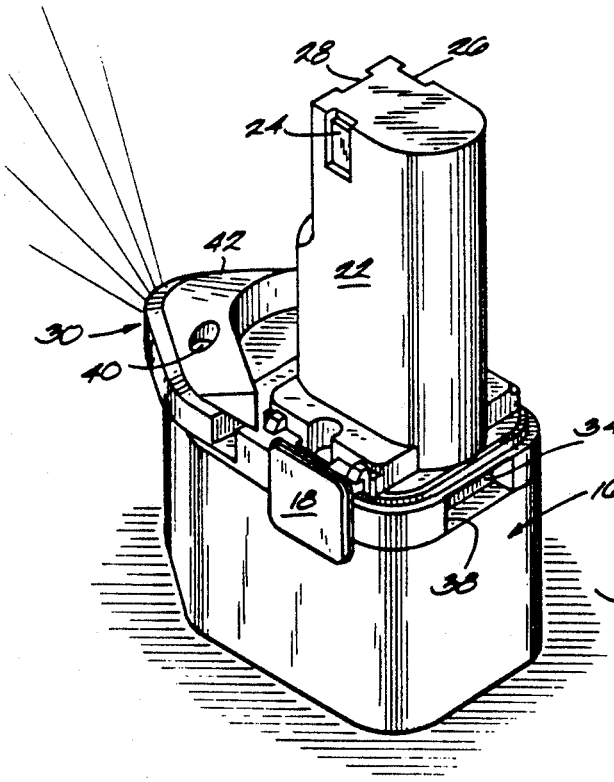
FIG. 2 is a perspective view of the power pack separate from the tool and having the light/switch moved to a projecting position in which the light beam is directed upwardly and forwardly.
Figure 3:
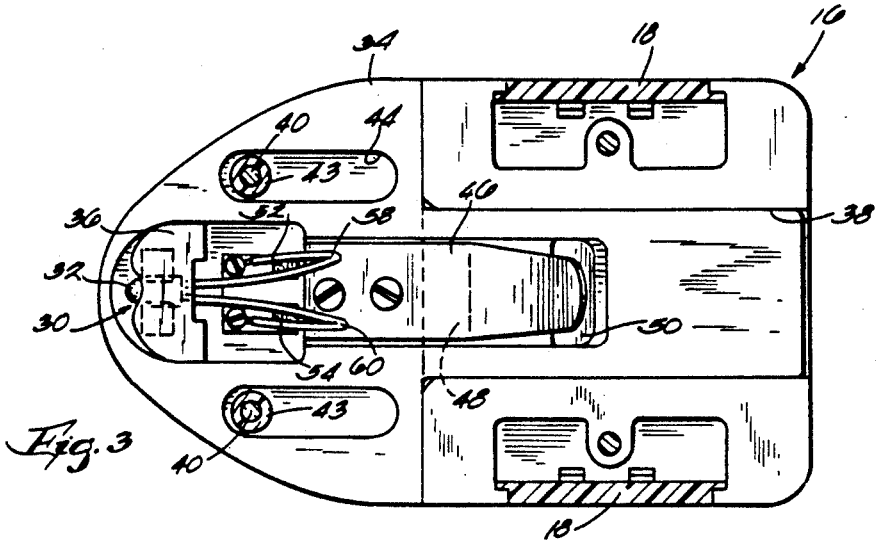
FIG. 3 is a plan view of the power pack shown in FIG. 2 and shows the light in its retracted position.
Figure 4:
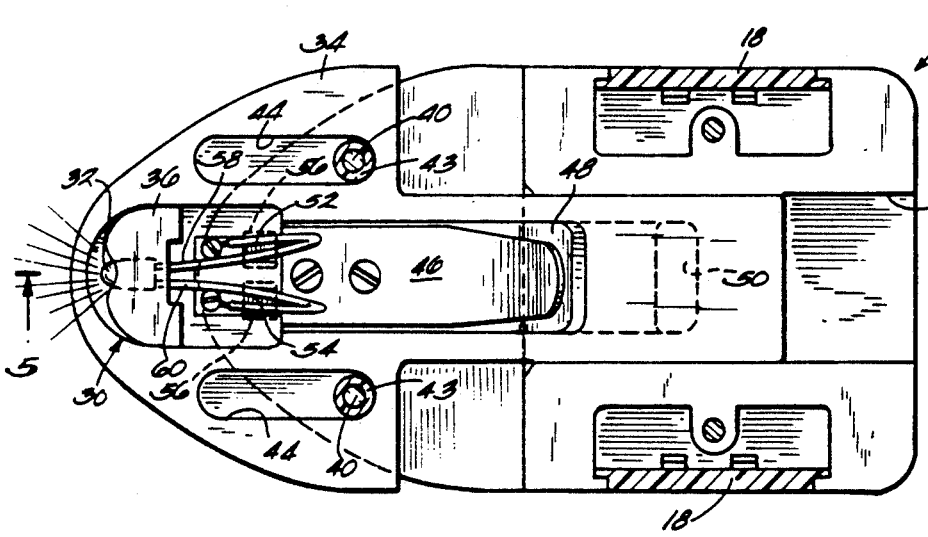
FIG. 4 is similar to FIG. 3 but has the light in its projecting position in which it is energized.

The hand power tool 10 shown in FIG. 1 may be a drill or a driver. The housing 12 encloses a battery powered motor and reduction gearing (not shown). The tool or implement (i.e., drill bit, etc.) holding mechinism is on the left end of the housing. The housing includes a depending grip 14 provided with a trigger 15 controlling a switch (not shown). A power pack 16 which contains the batteries is removable mounted on the bottom of the grip 14 with two opposed latches 18 engaging the bottom flange 20 of the grip portion 14 of the tool power. Rechargeable batteries are mounted in the base portion of power pack 16 and in the upstanding portion 22 which also functions as a registration key when assembling the power pack to the tool. The upper end of the key 22 has two contact strips 24, 26 for the d.c. power supply to the tool and also includes a contact strip at 28 for connection to the switch. The structure thus far described is much like the prior art. Where this invention differs from the art is the provision of a light 30 which is mounted in the power pack.

Figure 5:
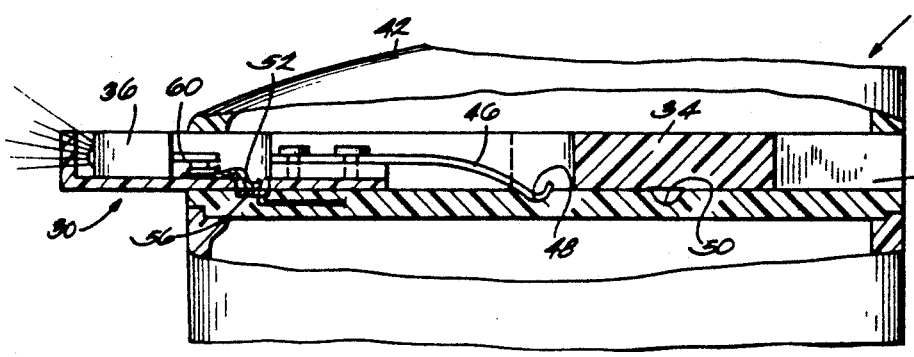
FIG. 5 is a vertical section taken on line 5—5 in FIG. 4.

The light 30 has a bulb 32 mounted in the front portion of the sliding member 34 made of clear plastic. The sliding member is shaped generally like a T lying on its side with the cross bar of the T being provided with a nose in which the light bulb is mounted. A reflector 36 is mounted in the nose adjacent the light to aim the light beam upwardly and forwardly to illuminate the drill bit or other implement and work area when the light is in use. The plastic bulb carrier 34 is slideably mounted in the power pack with the leg of the T shaped carrier guided in a channel 38 while each of the assembly screws 40 connecting the top 42 of the pack 16 to the base of the pack passes through a sleeve integral with the top 42 and each sleeve 43 passes through a slot 44 in the slider to guide the front of the slider. The slider has a spring loaded tongue 46 pressing downward to engage either detent groove 48 or 50 in the top surface of the base of the pack to hold the slider in the projecting position (shown in FIG. 5) or the retracted position in which the nose of the slider generally conforms to the contour of the front of the power pack. In the projecting position the two wipers 52, 54 engage fixed contact strips 56, 56 in the base to supply d.c. to the bulb 32 through wires 58, 60.

The right end (all views) of the slider is flush with the base surface when the light is in its retracted position. This enables the user to move the light to its "on" position by pressing on the end of the slider to at least move the nose partly out of its retracted (flush) position to facilitate grasping the nose to pull it all the way to its projecting (on) position.

The power pack can be removed from the tool quite easily as is often done for recharging or substituting a fresh pack. But with the present tool the pack can be removed for use as a separate flashlight, thus enhancing the utility of the power tool. A separate flashlight is often useful in construction work for inspection of remote (dark) areas and as a light when leaving the work area late in the day.

I claim:

1. A hand power tool, comprising, a housing, an electric motor in said housing, implement holding means mounted on said housing and driven by said motor, pistol grip means extending downwardly from said housing when an implement in said holding means is disposed horizontally, said grip means being adapted for manual engagement while operating the tool, said grip means having a first end attached to said housing and a second end remote from said housing, a light source mounted below said grip means at said second end, said light source directing light towards said holding means and an implement held thereby, and switch means controlling energization of said light source.

2. A power tool according to claim 1 in which said light source is a part of a power pack removably connected to said grip means, and said electric motor is battery powered.

3. A power tool according to claim 2 in which said light source is mounted in said power pack and is removable from said grip means along with the power pack for use as a flashlight separate from the tool.

4. A power tool according to claim 3 in which said power pack is mounted on the portion of the grip means most remote from said motor and said holding means and in which said light source is directed at a work area so said holding means and said implement held thereby will not cast a shadow on the work area when said light source is operated.

5. A power tool according to claim 4 in which said light source is mounted in said power pack for movement between a retracted position in which it lies within a contour of the power pack and a projecting position which it occupies when in use.

6. A power tool according to claim 5 in which said light source and said switch means are connected so movement of said light source between said positions operates said switch means.

* * * * *